US007695300B2

(12) United States Patent
Leccia et al.

(10) Patent No.: US 7,695,300 B2
(45) Date of Patent: Apr. 13, 2010

(54) ELECTRICALLY INSULATED CONDUCTOR CONNECTION ASSEMBLIES AND ASSOCIATED METHOD

(75) Inventors: Brad R. Leccia, Bethel Park, PA (US); Adri Lammers, Hengelo (NL); Francois Marchand, Mendham, NJ (US); Paul Schoten, Nijverdal (NL); Marcel Van Dijk, Enschede (NL); Gerard Schoonenberg, Hengelo (NL); Johannes Josephus Gerardus Van Thiel, Holten (NL)

(73) Assignee: Eaton Corporation, Cleveland, OH (US)

( * ) Notice: Subject to any disclaimer, the term of this patent is extended or adjusted under 35 U.S.C. 154(b) by 160 days.

(21) Appl. No.: 11/689,810

(22) Filed: Mar. 22, 2007

(65) Prior Publication Data

US 2008/0230359 A1 Sep. 25, 2008

(51) Int. Cl.
*H01R 13/15* (2006.01)

(52) U.S. Cl. ..... 439/263

(58) Field of Classification Search ..... 439/263, 439/736, 278, 283, 933, 271, 935, 281, 587, 439/191, 205; 310/71, 87; 174/77 R
See application file for complete search history.

(56) References Cited

U.S. PATENT DOCUMENTS

| | | | | |
|---|---|---|---|---|
| 5,120,268 | A * | 6/1992 | Gerrans | 439/736 |
| 5,221,214 | A * | 6/1993 | Martin | 439/191 |
| 5,704,799 | A * | 1/1998 | Wood | 439/281 |
| 5,801,465 | A * | 9/1998 | Yamada | 310/71 |
| 6,373,358 | B1 | 4/2002 | Davies et al. | |
| 7,053,327 | B2 | 5/2006 | Benke et al. | |

* cited by examiner

*Primary Examiner*—Edwin A. Leon
(74) *Attorney, Agent, or Firm*—Martin J. Moran

(57) ABSTRACT

An electrically insulated conductor connection assembly and a method for providing the same are provided. The electrically insulated conductor connection assembly includes first and second electrical conductors each comprising a body portion and an end portion. A fastening mechanism electrically and mechanically connects the end portions of the first electrical conductor to the end portion of the second electrical conductor, and an insulator overlays and electrically insulates the fastening mechanism. The end portions of the first and second electrical conductors and the fastening mechanism form a joint, which is structured to be fastenable and unfastenable. When the joint is fastened and the insulator is overlaying the fastening mechanism, the joint is electrically insulated.

5 Claims, 4 Drawing Sheets

ELECTRICALLY INSULATED CONDUCTOR CONNECTION ASSEMBLIES AND ASSOCIATED METHOD

BACKGROUND OF THE INVENTION

1. Field of the Invention

The invention relates generally to electrical switching apparatus and, more particularly, to conductor connection assemblies for electrical switching apparatus such as, for example, circuit breakers. The invention also relates to methods for providing electrically insulated conductor connection assemblies.

2. Background Information

Electrical switching apparatus, such as circuit breakers, provide protection for electrical systems from electrical fault conditions such as, for example, current overloads, short circuits, abnormal level voltage conditions and other fault conditions. Typically, circuit breakers include an operating mechanism having a switching device structured to open electrical contact assemblies in order to interrupt the flow of current through the conductors of an electrical system in response to such fault conditions.

For example, circuit breakers, such as power circuit breakers for systems operating above about 1,000 volts, typically employ vacuum interrupters as the switching devices. Vacuum interrupters include separable electrical contacts disposed within an insulating housing. Generally, one of the contacts is fixed relative to both the housing and to an external electrical conductor, which is electrically interconnected with a power circuit associated with the circuit breaker. In the case of a vacuum circuit interrupter, the other contact is typically part of a movable contact assembly. The movable contact assembly usually comprises a stem of circular cross-section having, at one end, the contact enclosed within a vacuum chamber and, at the other end, a driving mechanism which is external to the vacuum chamber. Power circuit breakers and vacuum interrupters therefor, are discussed in further detail, for example, in U.S. Pat. No. 6,373,358, which is incorporated herein by reference.

Electrically energized or "live" components of electrical switching apparatus must be sufficiently electrically insulated from nearby components that are electrically conductive, in order to resist undesirable electrical shorts. For example, this is particularly true in view of the market trend to design power circuit breakers to be as small and compact as possible. Specifically, the joints where electrical connections are made between components of the circuit breaker, such as between each terminal (e.g., line terminal; load terminal) and the corresponding electrical conductor (e.g., line conductor; load conductor) of the circuit breaker are one area where it is particularly difficult to achieve the requisite level of electrical insulation.

One prior proposal for providing the desired electrical insulation has been to fully encapsulate the joint in an epoxy insulation. Specifically, the joint, including the fastener(s) (e.g., without limitation, screw; bolt) that secures the joint together, have traditionally been completely covered with the epoxy insulation coating, which is molded to the joint under relatively high temperature and/or pressure, or via insulating sleeves. As the epoxy cools, it hardens, thereby forming a tight, electrically insulative bond. However, such an encapsulating approach disadvantageously makes it difficult, if not impossible, to unfasten (e.g., separate or disconnect) the individual components of the joint once it has been assembled and encapsulated. It is desirable, therefore, to provide electrically insulated conductor connection assemblies that can be relatively easily unfastened (e.g., disassembled).

There is, therefore, room for improvement in conductor connection assemblies for electrical switching apparatus, such as circuit breakers, and in methods of providing electrically insulated conductor connection assemblies.

SUMMARY OF THE INVENTION

These needs and others are met by embodiments of the invention, which are directed to conductor connection assemblies for electrical switching apparatus, such as circuit breakers, which are electrically insulated, yet are capable of being relatively easily unfastened.

As one aspect of the invention, a conductor connection assembly comprises: a first electrical conductor comprising a body portion and an end portion; a second electrical conductor comprising a body portion and an end portion; a fastening mechanism structured to electrically and mechanically connect the end portion of the first electrical conductor to the end portion of the second electrical conductor; and an insulator structured to overlay and electrically insulate the fastening mechanism. The end portion of the first electrical conductor, the end portion of the second electrical conductor, and the fastening mechanism form a joint, wherein the joint is structured to be fastenable and unfastenable, and wherein, when the joint is fastened and the insulator is overlaying the fastening mechanism, the joint is electrically insulated.

When the joint is fastened, the end portion of the first electrical conductor overlaps the end portion of the second electrical conductor. The end portion of the first electrical conductor may include a receptacle, wherein the receptacle is structured to receive the end portion of the second electrical conductor. The first electrical conductor may comprise an insulated tubular covering and a first round conductor including a plurality of resilient fingers. The end portion of the second electrical conductor may comprise a second round conductor. The resilient fingers may be structured to receive and retain the second round conductor of the second electrical conductor. When the joint is fastened, the second round conductor may be disposed within the resilient fingers of the first electrical conductor and the second insulated tubular covering of the second electrical conductor may overlap the resilient fingers of the first electrical conductor.

The end portion of the first electrical conductor may be a first protrusion extending outwardly from the body portion of the first electrical conductor, and the end portion of the second electrical conductor may be a second protrusion extending outwardly from the body portion of the second electrical conductor. Each of the first protrusion and the second protrusion may comprise an inner surface, an outer surface disposed opposite and distal from the inner surface, and an aperture. The fastening mechanism may comprise a fastener, wherein the fastener is structured to be inserted through the aperture of the first protrusion, into the aperture of the second protrusion, and fastened, in order to electrically connect the inner surface of the first protrusion to the inner surface of the second protrusion, thereby electrically connecting the first electrical conductor to the second electrical conductor. The fastener may include a first end having an enlarged head and a second end disposed opposite and distal from the enlarged head, and the second end of the fastener may be threaded. The aperture of the first protrusion of the first electrical conductor may further comprise a counter-bore extending from the outer surface of the first protrusion toward the inner surface of the first protrusion, wherein the enlarged head of the fastener is receivable within the counter-bore, and wherein the aperture of the second protrusion of the second electrical conductor is a threaded aperture structured to align with the aperture of the first electrical conductor and to receive the second end of the fastener. The insulator may be disposed in the counter-bore of the first protrusion of the first electrical conductor over the enlarged head of the fastener.

The body portion of the first electrical conductor may comprise an electrically conductive interior and an electrically insulative exterior overlaying the electrically conductive interior of the first electrical conductor, and the body portion of the second electrical conductor may comprise an electrically conductive interior and an electrically insulative exterior overlaying the electrically conductive interior of the second electrical conductor. When the joint is fastened, the electrically conductive interior of the first electrical conductor may abut the electrically conductive interior of the second electrical conductor, in order to electrically connect the first electrical conductor to the second electrical conductor, and the electrically insulative exterior of the first electrical conductor may abut the electrically insulative exterior of the second electrical conductor, in order to electrically insulate the joint. When the joint is fastened, the end portion of the first electrical conductor may abut the end portion of the second electrical conductor at an intersection, and the threaded fastener may be disposed within the through hole and threadingly engage the threaded aperture perpendicularly with respect to the intersection.

The conductor connection assembly may be a conductor connection assembly of a circuit breaker, wherein the circuit breaker includes a line terminal, a load terminal, a line conductor and a load conductor. The first electrical conductor may comprise one of the line terminal and the load terminal, and the second electrical conductor may comprise a corresponding one of the line conductor and the load conductor.

As another aspect of the invention, a method for providing an electrically insulated conductor connection assembly comprises: electrically connecting an end portion of a first electrical conductor to an end portion of a second electrical conductor; fastening the end portion of the first electrical conductor to the end portion of the second electrical conductor using a fastening mechanism, thereby forming a joint; and applying an insulator over the fastening mechanism, in order to electrically insulate the joint. The joint is unfastenable after applying the insulator.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
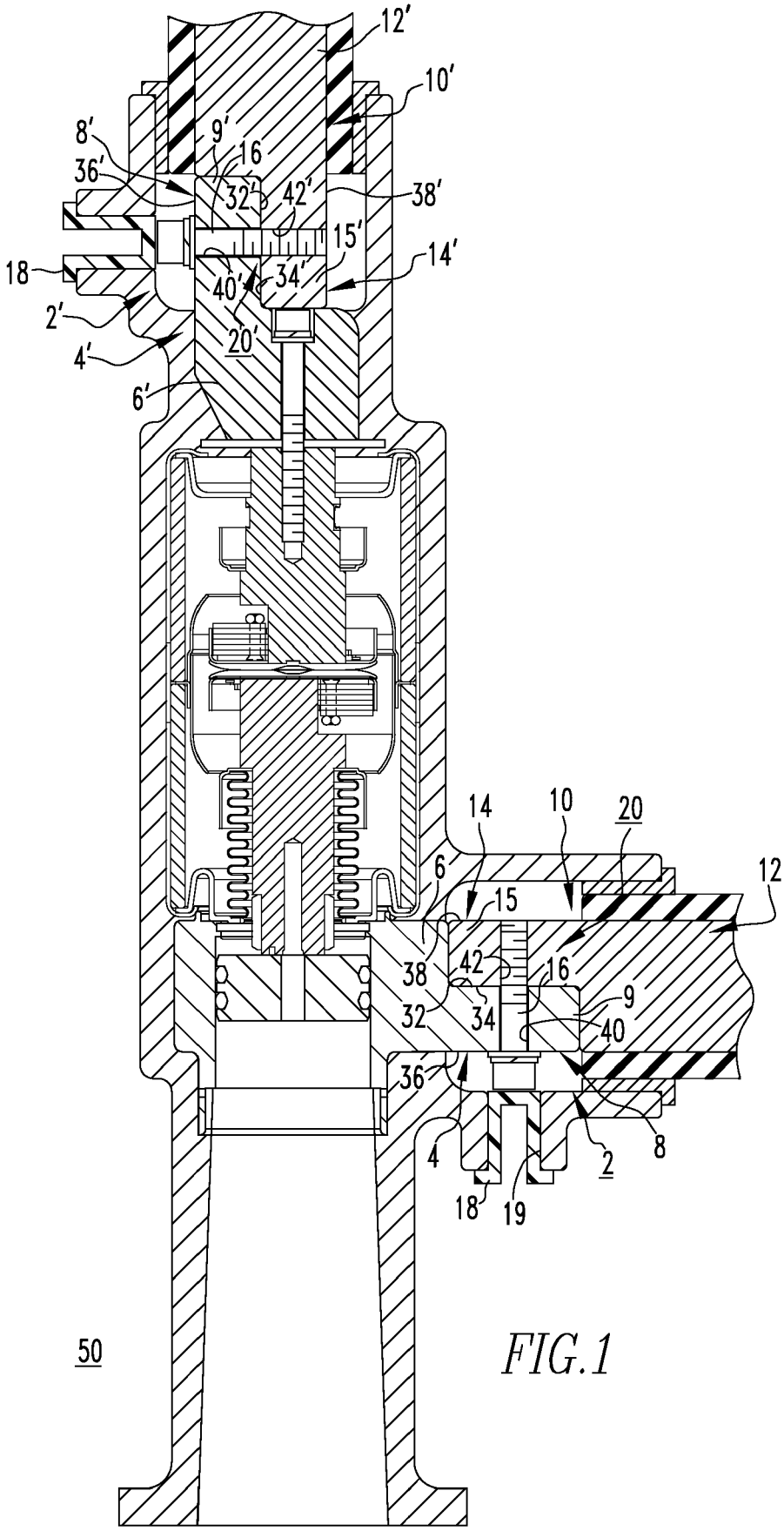
FIG. 1 is a side elevation view of a portion of a power circuit breaker and an electrically insulated conductor connection assembly therefor, in accordance with an embodiment of the invention.

For purposes of illustration, embodiments of the invention will be described as applied to power circuit breakers, although it will be appreciated that they could also be applied to electrically insulate the conductor connection assemblies of any known or suitable electrical switching apparatus (e.g., without limitation, circuit switching devices and other circuit interrupters, such as contactors, motor starters, motor controllers and other load controllers) other than power circuit breakers.

Directional phrases used herein, such as, for example, left, right, front, back, top, bottom and derivatives thereof, relate to the orientation of the elements shown in the drawings and are not limiting upon the claims unless expressly recited therein.

As employed herein, the terms "fastener" and "fastening mechanism" refer to any suitable connecting or tightening material or device and expressly includes, but is not limited to, resilient members (e.g., without limitation, resilient fingers) structured to bias against, and thereby secure another component, screws, bolts and the combinations of bolts and nuts (e.g., without limitation, lock nuts) and bolts, washers and nuts.

As employed herein, the term "electrical conductor" refers to any known or suitable component expressly intended to conduct electrical current and expressly includes, but is not limited to, electrical terminals (e.g., without limitation, line terminals; load terminals) and electrically conductive components (e.g., without limitation, electrical wires; electrical cables; line conductors; load conductors; bus bars; load bus; line bus) structured to be electrically connected to such electrical terminals.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Among other improvements, the conductor connection assemblies disclosed herein have been designed to provide joints between electrical conductors which are sufficiently electrically insulated from surrounding electrically conductive components (e.g., without limitation, metallic components of a circuit breaker or circuit breaker mounting apparatus), while the components of the joints are relatively easy to unfasten in comparison with, for example, known conductor connection assemblies in which the entire joint is encapsulated with an electrical insulator (e.g., without limitation, an electrically insulative epoxy coating). As a result, the components of the joint of the disclosed electrically insulated conductor connection assemblies can be unfastened (e.g., disassembled) in order to, for example, replace a component that has failed, without requiring the entire conductor connection assembly, or electrical components electrically connected thereto, to be replaced. The following examples disclose several ways of accomplishing these results.

Figure 3A:
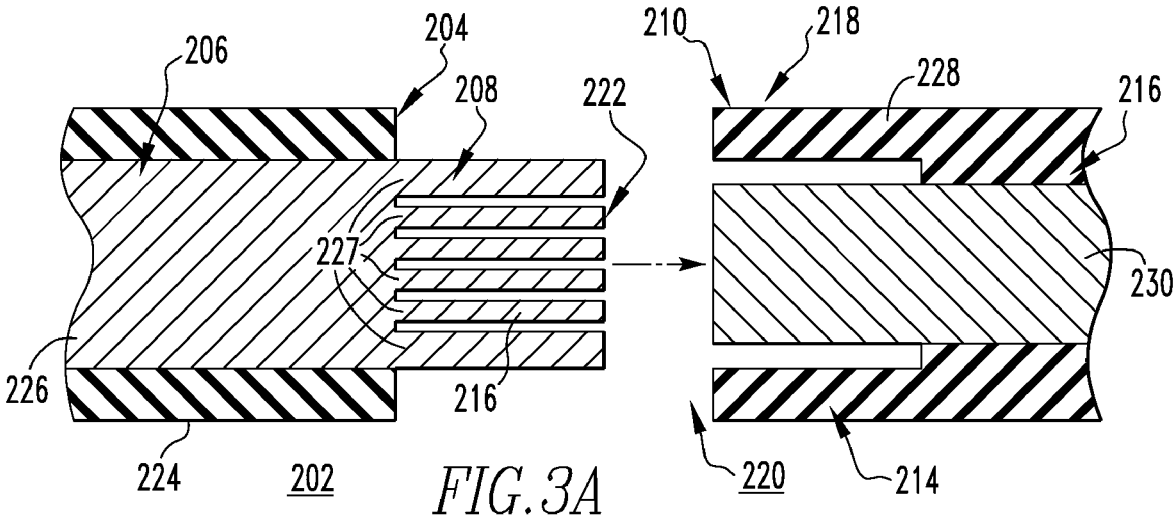
FIG. 3A is an exploded side elevation view of an electrically insulated conductor connection assembly in accordance with another embodiment of the invention.
Figure 3B:
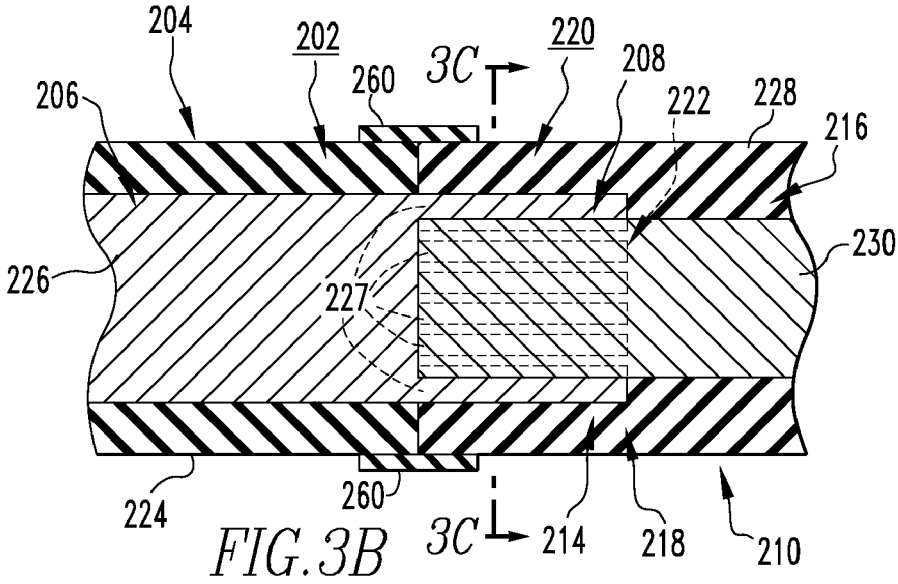
FIG. 3B is an assembled side elevation view of the electrically insulated conductor connection assembly of FIG. 3A.
Figure 3C:
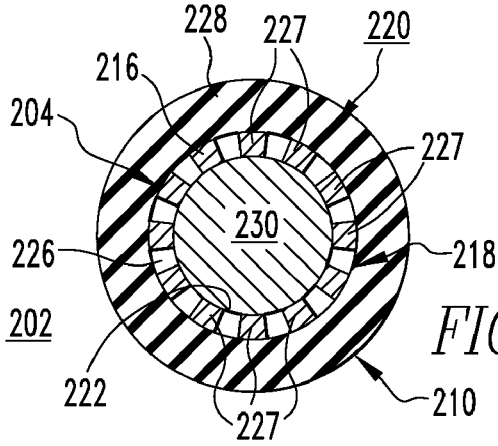
FIG. 3C is a sectional view taken along lines 3C-3C of FIG. 3B.
Figure 4:
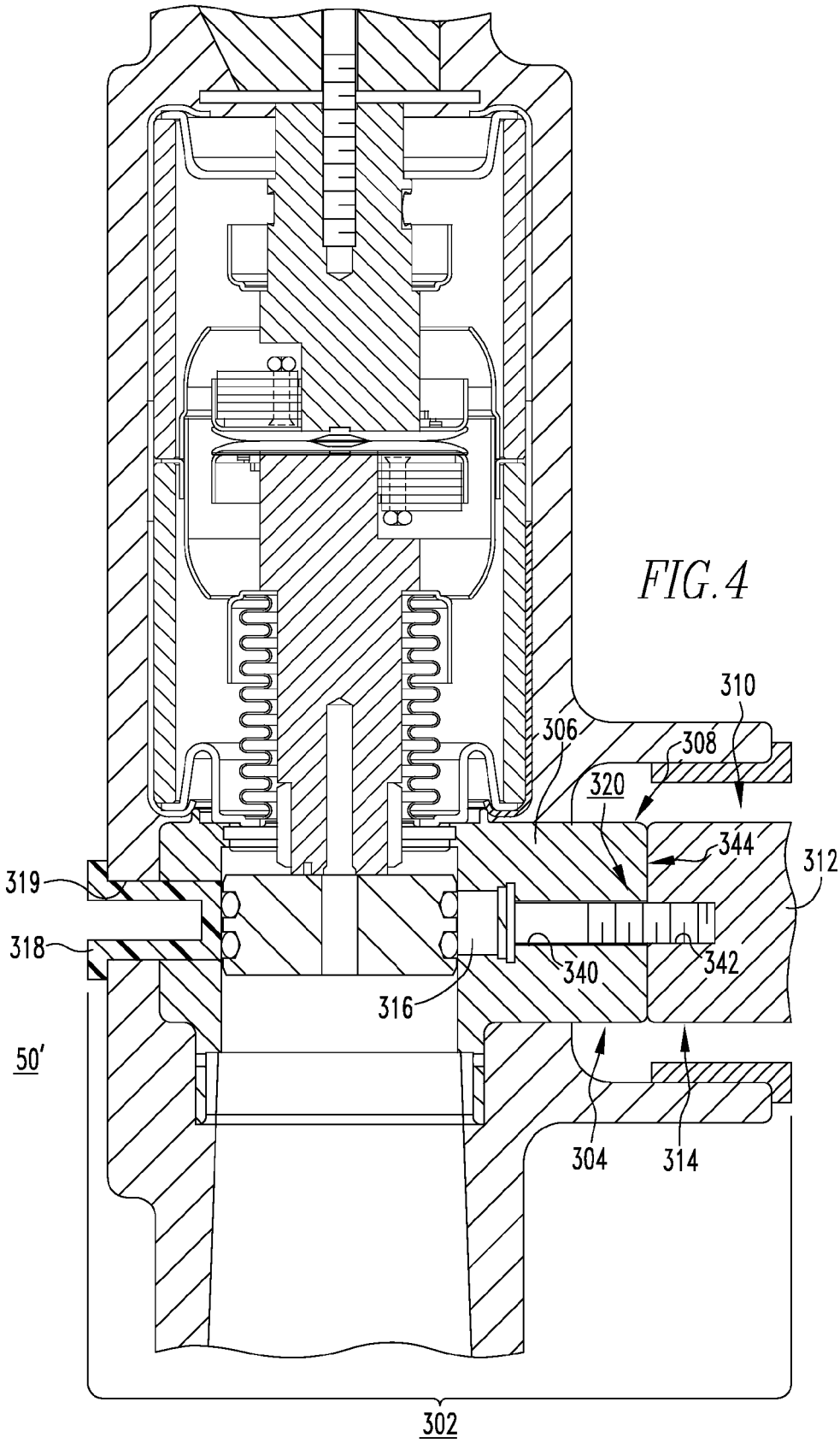
FIG. 4 is a side elevation view of a portion of a power circuit breaker employing an electrically insulated conductor connection assembly in accordance with another embodiment of the invention.

In each example shown and described herein, like components are numbered similarly. For example, the various components of the conductor connection assembly embodiment shown and described with respect to FIG. 1 are numbered with single digit reference numbers, whereas the embodiment of FIGS. 2A-2E is numbered similarly but with 100 series reference numbers, the embodiment of FIGS. 3A-3C is numbered similarly but with 200 series reference numbers, and the embodiment of FIG. 4 is numbered similarly but with 300 series reference numbers. For economy of disclosure, similar features present in more than one embodiment of the invention are shown, but may not be repetitively discussed.

EXAMPLE 1

FIG. 1 shows two conductor connection assemblies 2,2' for an electrical switching apparatus, such as the power circuit breaker 50 which is partially shown. It will, therefore, be appreciated that in the example of FIG. 1, the conductor connection assemblies comprise a load conductor connection assembly 2 and a line conductor connection assembly 2'. The load conductor connection assembly 2 includes a first electrical conductor 4 having a body portion 6 and an end portion 8, and a second electrical conductor 10 having a body portion 12 (partially shown) and an end portion 14. The first electrical conductor 4 of the example load conductor connection assembly 2 is the load terminal 4 of the power circuit breaker 50, and the second electrical conductor 10 is a corresponding load conductor 10 (e.g., without limitation, load bus; electrical cable; electrical wire) which is structured to be electrically connected to the load terminal 4 by a fastening mechanism such as, for example and without limitation, the threaded fastener 16, which is shown. An insulator such as, for example and without limitation, the electrically insulative plug 18 which is shown, is structured to overlay and electrically insulate the fastening mechanism 16. The end portions 6,14 of the first and second electrical conductors 4,10, respectively, along with the fastening mechanism 16, form a joint 20. The joint 20 is structured to be fastenable and unfastenable, as previously discussed. When the joint 20 is fastened and insulator 18 is overlaying the fastening mechanism 16, as shown, the joint 20 is electrically insulated.

More specifically, when the joint 20 is fastened, portion 8 of the first electrical conductor 4, which in the example of FIG. 1 is a first protrusion 9 extending outwardly from the body portion 6 of the first electrical conductor 4, overlaps the end portion 14 of the second electrical conductor 10, which in the example of FIG. 1 is a second protrusion 15 extending outwardly from the body portion 12 of the second electrical conductor 10. The first protrusion 9 includes a first aperture or through hole 40, and the second protrusion 15 includes a second aperture 42, which in the example of FIG. 1 is threaded to receive the corresponding threaded end of fastener 16. In the example of FIG. 1, the first and second protrusions 9,15 are substantially identical in size and shape, although it will be appreciated that they could have any suitable shape and configuration other than that which is shown, without departing from the scope of the invention.

Accordingly, the disclosed method for providing the electrically insulated conductor connection assembly 2 involves the steps of overlapping the first protrusion 9 of the first electrical conductor 4 with the second protrusion 15 of the second electrical conductor 10, aligning the first aperture 40 with the second aperture 42, and inserting the fastener 16 through the first aperture 40 into the second aperture 42 and fastening it to secure the joint 20. The electrically insulative plug 18 is then applied to overlay the fastener 16, in order to electrically insulate the joint 20. In the example of FIG. 1, the electrically insulating plug 18 is secured within an opening 19 of the power circuit breaker 50, which is aligned with the fastener 16 and with the first and second apertures 40,42 of the load terminal and conductor 4,10, respectively.

It will be appreciated that the line conductor connection assembly 2' and the method of electrically insulating the same are substantially similar to those previously discussed in connection with the load conductor connection assembly 2. For economy of disclosure, the components of the line conductor connection assembly 2' include the same reference numbers as load conductor connection assembly 2, but are distinguished by the addition of a prime symbol to each reference number (e.g., without limitation, line terminal 4' and line conductor 10').

Accordingly, the conductor connection assemblies 2,2' in the example of FIG. 1 provide joints 20,20' which are electrically insulated, but which may also be readily unfastened (e.g., disassembled) by simply removing the electrically insulating plugs 18 and unfastening fasteners 16. Thus, components (e.g., without limitation, load conductor 12,12'; fastener 16) of the joint 20,20' can be relatively easily replaced or exchanged, without requiring the entire conductor connection assembly 2,2', or for that matter, a substantial portion of the circuit breaker 50, to be replaced.

EXAMPLE 2

Figure 2C:
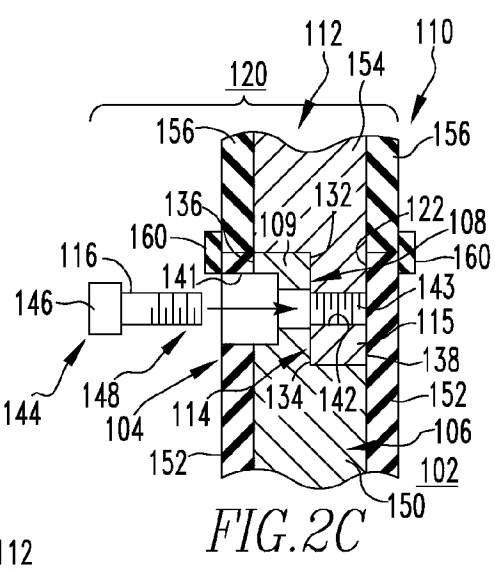
FIGS. 2A, 2B, 2C, 2D and 2E are side elevation views of the components of an electrically insulated conductor connection assembly, and the sequential steps of a method for providing the same, in accordance with embodiments of the invention.
Figure 2B:
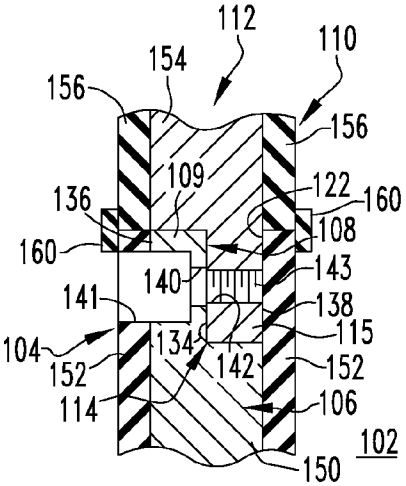
Figure 2A:
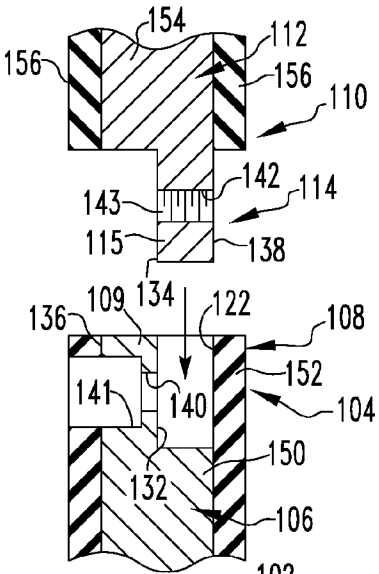
Figure 2E:
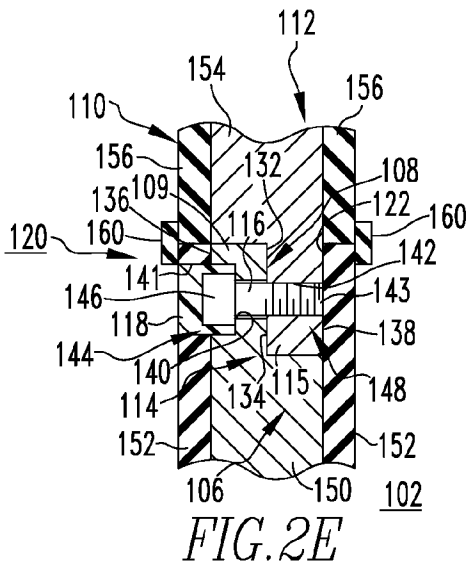
Figure 2D:
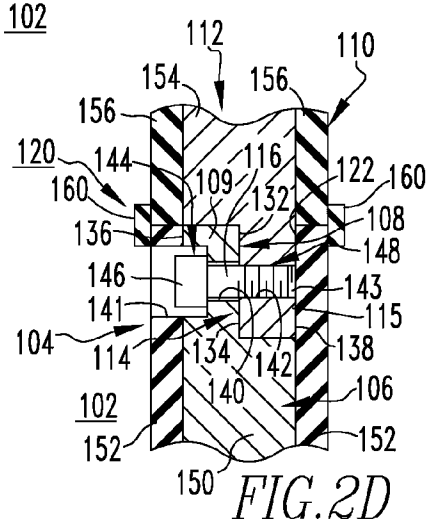

FIGS. 2A-2E show a conductor connection assembly 102, and the sequential steps of forming and electrically insulating the same. The first and second electrical conductors 104,110 of the conductor connection assembly 102 are substantially similar to electrical conductors 4,10 previously discussed in connection with FIG. 1, but the first electrical conductor 104 further includes a receptacle 122. The receptacle 122 is structured to receive protrusion 115 of the end portion 114 of the second electrical conductor 110, as shown in FIGS. 2B-2E. Similar to conductor connection assembly 2 of FIG. 1, when the joint 120 (FIGS. 2C-2E) of conductor connection assembly 102 is fastened (FIGS. 2D and 2E), the first and second protrusions 109,115 of the end portions 108,114 of the first and second electrical conductors 104,110, respectively, overlap one another in order that the first and second apertures 140,142 of the end portions 108,114, respectively, align with respect to one another to receive fastener 116 (FIGS. 2C-2E).

More specifically, each of the first and second protrusions 109,115 of the first and second electrical conductors 104,110, respectively include an inner surface 132 and 134, and an outer surface 136 and 138 disposed opposite and distal from the inner surface 132 and 134 (see also, inner surfaces 32 and 34 and outer surfaces 36 and 38 of first and second protrusions 109 and 115, respectively, and inner surfaces 32' and 34' and outer surfaces 36' and 38' of the first and second protrusions 9' and 15', respectively, of FIG. 1). Accordingly, assembling the joint 120 (FIGS. 2C-2E) involves the steps of inserting the second protrusion 115 of second electrical conductor 112 into the receptacle 122 of the first electrical conductor 104 until the aperture 140 of the first protrusion 109 aligns with the aperture 142 of the second protrusion 115, as shown in FIG. 2B, and then inserting and fastening the fastener 116, as sequentially shown in FIGS. 2C and 2D, in order to electrically connect the inner surface 132 of first protrusion 109 to inner surface 134 of second protrusion 115, thereby electrically connecting the first and second electrical conductors 104,110.

The example fastener 116 (FIGS. 2C-2E) includes a first end 144 having an enlarged head 146 and as second end 148 disposed opposite and distal from the enlarged head 146. The second end 148 of the example fastener 116 is also threaded. The aperture 140 of the first protrusion 109 comprises a through hole 140 including a counter-bore 141. The counter-bore 141 extends from the outer surface 136 of the first protrusion 109 toward the inner surface 132, and is structured to receive the enlarged head 146 of the fastener 116, as shown in FIGS. 2D and 2E. The aperture 142 of the second protrusion 115 of second electrical conductor 110 is a threaded aperture 143 structured to receive the threaded end 148 of fastener 116, as shown in FIGS. 2D and 2E. As shown in FIG. 2E, the method of electrically insulating the example conductor connection assembly 102 is completed by filling the counter-bore 141 of the first protrusion 109 of first electrical conductor 104 with an insulator 118 (e.g., without limitation, an electrically insulating epoxy (shown); an electrically insulating covering; an electrically insulating plug (see for example, plugs 18 of FIG. 1 and plug 318 of FIG. 4)) over the enlarged head 146 of the fastener 116.

The body portion 106 of first electrical conductor 104 comprises an electrically conductive interior 150 (e.g., without limitation, copper; metal) and an electrically insulative exterior 152 (e.g., without limitation, an electrically insulative epoxy coating; electrically insulative plastic; electrically insulative rubber). Similarly, the body portion 112 of second electrical conductor 110 comprises an electrically conductive interior 154 and an electrically insulative exterior 156 overlaying the interior 154. When the joint 120 is fastened, as shown in FIGS. 2D and 2E, the electrically conductive interior 150 of the first electrical conductor 104 abuts the electrical conductive interior 154 of the second electrical conductor 110, and is fastened by screw 116 in order to electrically connect the first and second electrical conductors 104,110, as previously discussed, and the electrically insulative exteriors 152,156 of the first and second electrical conductors 104,110, respectively, abut one another, in order to further electrically insulate the joint 120. Preferably, one of the electrically insulative exteriors 152,156 overlaps (not shown) the other of the electrically insulative exteriors 152,156 or the location at which the electrically insulative exteriors 152,156 abut is overlayed with another electrical insulator 160 (shown in simplified form in FIGS. 2B-2E) (see also insulator 260 in FIG. 3B) of any suitable size, shape and configuration. In the example of FIGS. 2A-2E, the counter-bore 141 of the first protrusion 109 of first electrical conductor 104 extends through insulator 160 and the electrically insulative exterior 152 of the first electrical conductor 104, and is subsequently filled with insulator 118 (FIG. 2E), as previously discussed.

EXAMPLE 3

FIGS. 3A-3C show a conductor connection assembly 202 in which the first electrical conductor 204 comprises an insulated tubular covering 224 and a first round conductor 226 including a plurality of resilient fingers 227 surrounding a receptacle 222. The receptacle 222 is structured to receive a corresponding second round conductor 230 of the second electrical conductor 210, as shown in FIGS. 3B and 3C. Specifically, the resilient fingers 227 bias against the second round conductor 230 of second electrical conductor 210 in order to retain the second round conductor 230 within the receptacle 222.

The second electrical conductor 210 also includes an insulated tubular covering 228, which as best shown in FIG. 3A, is spaced from the second round conductor 230 at or about the end portion 214 of the second electrical conductor 210. Thus, when the joint 220 is fastened, the second round conductor 230 is disposed within the resilient fingers 227 of the first electrical conductor 204, and the receptacle 222 formed thereby, and the insulative tubular cover 228 of the second electrical conductor 210 overlaps the resilient fingers 227 of the first electrical conductor 204, as shown in FIGS. 3B and 3C. The over lapping nature of the insulated tubular covering 228 of the second electrical second conductor 210 over the resilient fingers 227 of the first electrical conductor 204, comprises the insulator 218 for electrically insulating the joint 220.

EXAMPLE 4

FIG. 4 shows a conductor connection assembly 302 for a power circuit breaker 50'. The first electrical conductor 304 of the conductor connection assembly 302 is a load terminal 304 of the circuit breaker 50', and the second electrical conductor 310 is a load conductor 310 (partially shown). The load terminal 304 includes a body portion 306 and an end portion 308 extending outwardly from a portion of the circuit breaker 50'. The load conductor 310 (e.g., without limitation, load bus; electrical cables; electrical wire) includes a body portion 312 and an end portion 314 structured to abut the end portion 308 of the load terminal 304 at an intersection 344. The fastening mechanism of the conductor connection assembly 302 comprises a threaded fastener 316, which is inserted through a through hole 340 in the end portion 308 of the load terminal 304, and into an aligned threaded aperture 342 of the end portion 314 of the load conductor 310. When the threaded fastener 316 is fastened to secure the joint 320, the end portion 308 is electrically connected to the end portion 314 of the load conductor 310 at the intersection 344, with the threaded fastener 316 being disposed within through hole 340 and threadingly engaged in threaded aperture 342 perpendicularly with respect to such intersection 344, as shown.

In order to electrically insulate the joint 320, an electrically insulating plug 318 is disposed within an aperture 319 of the circuit breaker 50' at a location opposite and distal from the threaded fastener 316. It will, however, be appreciated that the joint 320 could alternatively be insulated using any known or suitable insulator (e.g., without limitation, electrically insulative epoxy; electrically insulative covering) other than the electrically insulative plug 318, without departing from the scope of the invention.

EXAMPLE 5

It will be appreciated that the disclosed electrically insulated conductor connection assemblies 2,2',102,202,302 and components (e.g., without limitation, first electrical conductor 4,4',104,204,304; second electrical conductor 10,10', 110, 210,310; fastening mechanisms 16,116,216,316; insulator 18,118,218,318) thereof could be employed individually or in any suitable combination. It will also be appreciated that such conductor connection assemblies 2,2',102,202,302 could be employed in any suitable number and configuration as part of a wide variety of electrical switching apparatus such as, for example and without limitation, the power circuit breakers 50,50', previously discussed in connection with FIGS. 1 and 4.

Accordingly, the disclosed conductor connection assemblies 2,2', 102,202,302 provide joints 20,20', 120,220,320 in which electrically conductive components (e.g., without limitation, first electrical conductor 4,4',104,204,304; second electrical conductor 10,10', 110,210,310; fastening mechanisms 16,116,216,316; and insulators 18,118,218,318) are effectively electrically connected and electrically insulated from surrounding electrically conductive components, yet the joints 20,20',120,220,320 are also capable of being relatively easily unfastened and refastened, without requiring complete replacement of the electrical conductor assembly 2,2',102, 202,302, and/or electrical components (e.g., without limitation, power circuit breakers 50,50') to which they are electrically connected, to be replaced.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A conductor connection assembly comprising:

a first electrical conductor comprising a body portion and an end portion;

a second electrical conductor comprising a body portion and an end portion;

a fastening mechanism structured to electrically and mechanically connect the end portion of said first electrical conductor to the end portion of said second electrical conductor;

and an insulator structured to overlay and electrically insulate said fastening mechanism, wherein the end portion of said first electrical conductor, the end portion of said second electrical conductor, and said fastening mechanism form a joint, wherein said joint is structured to be fastenable and unfastenable, and wherein, when said joint is fastened and said insulator is overlaying said fastening mechanism, said joint is electrically insulated, wherein, when said joint is fastened, the end portion of said first electrical conductor overlaps the end portion of said second electrical conductor, wherein the end portion of said first electrical conductor is a first protrusion extending outwardly from said body portion of said first electrical conductor;

wherein the end portion of said second electrical conductor is a second protrusion extending outwardly from said body portion of said second electrical conductor; wherein each of said first protrusion and said second protrusion comprises an inner surface, an outer surface disposed opposite and distal from said inner surface, and an aperture; wherein said fastening mechanism comprises a fastener; and wherein said fastener is structured to be inserted through said aperture of said first protrusion, into said aperture of said second protrusion, and fastened, in order to electrically connect said inner surface of said first protrusion to said inner surface of said second protrusion, thereby electrically connecting said first electrical conductor to said second electrical conductor.

2. The conductor connection assembly of claim 1 wherein electrically connect said inner surface of said first protrusion to said inner surface of said second protrusion, thereby electrically connecting said first electrical conductor to said second electrical conductor, the end portion of said first electrical conductor includes a receptacle; and wherein said receptacle is structured to receive the end portion of said second electrical conductor.

3. The conductor connection assembly of claim 1 wherein said first protrusion of said first electrical conductor and said second protrusion of said second electrical conductor are substantially identical in shape and size.

4. The conductor connection assembly of claim 1 wherein said insulator is selected from the group consisting of an electrically insulative epoxy, electrically insulative coating, and an electrically insulative plug.

5. The conductor connection assembly of claim 1 wherein said conductor connection assembly is a conductor connection assembly of a circuit breaker; wherein said circuit breaker includes a line terminal, a load terminal, a line conductor and a load conductor; wherein said first electrical conductor comprises one of said line terminal and said load terminal; and wherein said second electrical conductor comprises a corresponding one of said line conductor and said load conductor.

* * * * *